US008888021B2

(12) United States Patent
Yasukawa et al.

(10) Patent No.: US 8,888,021 B2
(45) Date of Patent: Nov. 18, 2014

(54) FUEL INJECTOR

(75) Inventors: Yoshihito Yasukawa, Hitachinaka (JP); Yoshio Okamoto, Omitama (JP); Takahiro Saito, Isesaki (JP); Masanori Ishikawa, Tsuchiura (JP); Eiji Ishii, Hitachinaka (JP); Nobuaki Kobayashi, Maebashi (JP); Noriyuki Maekawa, Kashiwa (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 504 days.

(21) Appl. No.: 13/344,665

(22) Filed: Jan. 6, 2012

(65) Prior Publication Data

US 2012/0193566 A1 Aug. 2, 2012

(30) Foreign Application Priority Data

Jan. 31, 2011 (JP) ..... 2011-017388

(51) Int. Cl.

| | |
|---|---|
| ***F02M 61/00*** | (2006.01) |
| ***F02M 61/18*** | (2006.01) |
| ***F02M 61/16*** | (2006.01) |
| *F02M 51/06* | (2006.01) |

(52) U.S. Cl.

CPC ..... *F02M 61/188* (2013.01); *F02M 51/061* (2013.01); *F02M 61/1853* (2013.01); *F02M 61/162* (2013.01)

USPC ..... 239/533.12; 239/486

(58) Field of Classification Search

CPC .. F02M 55/008; B05B 1/3405; B05B 1/3415; B05B 1/3468

USPC ..... 239/533.12, 461, 486, 463, 487, 483

See application file for complete search history.

(56) References Cited

U.S. PATENT DOCUMENTS

| | | | | |
|---|---|---|---|---|
| 3,182,916 | A | 5/1965 | Schulz | |
| 3,532,271 | A | 10/1970 | Polnauer | |
| 3,680,793 | A | 8/1972 | Tate et al. | |
| 5,570,841 | A * | 11/1996 | Pace et al. | 239/585.1 |
| 6,039,272 | A * | 3/2000 | Ren et al. | 239/597 |
| 6,796,516 | B2 * | 9/2004 | Maier et al. | 239/533.12 |
| 6,938,840 | B1 * | 9/2005 | Trutschel et al. | 239/533.12 |
| 7,198,201 | B2 | 4/2007 | Bowman et al. | |

FOREIGN PATENT DOCUMENTS

| | | |
|---|---|---|
| JP | 49-34009 | 3/1974 |
| JP | 3-182916 A | 8/1991 |
| JP | 7-198201 A | 8/1995 |
| JP | 2002-52355 A | 2/2002 |
| JP | 2003-336562 A | 11/2003 |

OTHER PUBLICATIONS

Japanese-language Office dated Apr. 26, 2013 (three (3) pages).
Chinese Office Action with English translation dated Jan. 6, 2014 (eight (8) pages).

* cited by examiner

*Primary Examiner* — Davis Hwu
(74) *Attorney, Agent, or Firm* — Crowell & Moring LLP

(57) ABSTRACT

A fuel injection valve includes: a swirl chamber having an inner peripheral wall formed to be gradually increased in curvature toward a downstream side from an upstream side; a swirl passage, through which a fuel is introduced into the swirl chamber; and a fuel injection port opened to the swirl chamber, wherein the swirl chamber and the swirl passage are formed so that a side wall of the swirl passage connected to a downstream end side of the swirl chamber, or an extension thereof is made not to intersect a downstream side portion of the inner peripheral wall of the swirl chamber, or an extension thereof.

9 Claims, 9 Drawing Sheets

FUEL INJECTOR

BACKGROUND OF THE INVENTION

The present invention relates to a fuel injection valve used in internal combustion engines to inject a swirling fuel to enable achieving an improvement in atomizing performance.

A fuel injection valve described in JP-A-2003-336562 is known as prior art, in which a swirling flow is made use of to accelerate atomization of a fuel injected from a plurality of fuel injection ports.

In this fuel injection valve, a lateral passage in communication with a downstream end of a valve seat and a swirl chamber into which a downstream end of the lateral passage is opened tangentially are formed between a valve seat member, to a front end surface of which a downstream end of the valve seat cooperating with a valve body is opened, and an injector plate joined to the front end surface of the valve seat member, and a fuel injection port, from which a fuel given swirl in the swirl chamber is injected is formed in the injection plate, and the fuel injection port is arranged offset a predetermined distance toward an upstream end of the lateral passage from a center of the swirl chamber.

Also, in this fuel injection valve, an inner peripheral surface of the swirl chamber is decreased in radius of curvature toward a downstream side from an upstream side in a direction along the inner peripheral surface of the swirl chamber. That is, the curvature is increased toward the downstream side from the upstream side in the direction along the inner peripheral surface of the swirl chamber. Also, the inner peripheral surface of the swirl chamber is formed along an involute curve having a basic circle in the swirl chamber.

Such construction enables effectively accelerating atomization of a fuel from respective fuel injection ports.

In order to inject a swirling fuel, which is symmetric (uniform) in swirl intensity in a circumferential direction, from a fuel injection port, it is necessary to contrive a flow passage configuration including the shape of a swirl chamber and a lateral passage (swirl passage) in order to make a swirling flow symmetrical at an outlet of the fuel injection port.

In the prior art described in JP-A-2003-336562, one (a side wall connected to an upstream end of an inner peripheral surface of a swirl chamber in a fuel swirling direction) of side walls, which define a lateral passage, is connected tangentially to the inner peripheral surface of the swirl chamber and the other (a side wall connected to a downstream end of the inner peripheral surface of the swirl chamber in the fuel swirling direction) of the side walls is provided in a manner to intersect the inner peripheral surface of the swirl chamber. Therefore, a connection of both walls, on which the other of the side walls and the inner peripheral surface of the swirl chamber intersect each other, is shaped to be sharp at the point like a knife edge.

With such connection, when the side wall of the lateral passage or the inner peripheral surface of the swirl chamber is minutely dislocated, the connection of both walls is liable to be dislocated. Such dislocation of the connection is responsible for generation of steep drift toward a fuel injection port, so that it is possible that a swirling flow is damaged in symmetric property (uniformity).

SUMMARY OF THE INVENTION

The invention has been thought of in view of the circumstances described above and has its object to provide a fuel injection valve, which is heightened in uniformity in a circumferential direction of a swirling flow.

In order to attain the above object, the invention provides a fuel injection valve including a swirl chamber having an inner peripheral wall formed to be gradually increased in curvature toward a downstream side from an upstream side, a swirl passage, through which a fuel is introduced into the swirl chamber, and a fuel injection port opened to the swirl chamber, wherein the swirl chamber and the swirl passage are formed so that a side wall of the swirl passage connected to a downstream end side of the swirl chamber, or an extension thereof is made not to intersect a downstream side portion of the inner peripheral wall of the swirl chamber, or an extension thereof.

At this time, assuming, respectively, a first straight line segment connecting between a center of the swirl chamber and a starting point of the inner peripheral wall of the swirl chamber on an upstream side, a first point Y0, at which the first line segment and an extension of the inner peripheral wall extended toward a downstream side intersect each other, a second straight line segment passing through the first point Y0 and being perpendicular to the first line segment, a second point P0, at which the second line segment intersects the inner peripheral wall or an extension thereof on an upstream side of the first point Y0, a third straight line segment connecting between the second point P0 and the center of the swirl chamber, a third point, at which the side wall of the swirl passage and the third line segment intersect each other, a fourth straight line segment being parallel to the second line segment and being in contact with the inner peripheral wall or an extension thereof between the first point and the second point, and a fourth point, at which the fourth line segment intersects the third line segment, it is preferable that the third point is positioned on the third line segment on a side more distant from the center of the swirl chamber than the fourth point.

Also, it is preferable that the cross section of the swirl chamber is defined by an involute curve or a spiral curve.

Also, it is preferable that a thickness forming portion is formed between a downstream end of the side wall of the swirl passage and a downstream end of the inner peripheral wall of the swirl chamber.

Also, it is preferable that the cross section of the thickness forming portion is defined by a circular-shaped portion.

Also, it is preferable that the circular-shaped portion is formed to be in contact with the inner peripheral wall and the side wall at the downstream end of the inner peripheral wall and the downstream end of the side wall.

Also, in order to attain the above object, the invention provides a fuel injection valve including a swirl chamber having an inner peripheral wall formed to be gradually increased in curvature toward a downstream side from an upstream side, a swirl passage, through which a fuel is introduced into the swirl chamber, and a fuel injection port opened to the swirl chamber, wherein a thickness forming portion is formed between a downstream end of a side wall of the swirl passage connected to a downstream end side of the swirl chamber and a downstream end of the inner peripheral wall of the swirl chamber.

It is preferable that the cross section of the thickness forming portion is defined by a circular-shaped portion.

It is preferable that the circular-shaped portion is formed to be in contact with the inner peripheral wall and the side wall at the downstream end of the inner peripheral wall and the downstream end of the side wall.

According to the invention, the connection of the swirl chamber and the swirl passage, that is, a portion, at which a fuel inflowing from the swirl passage and a fuel orbiting in the swirl chamber merge together, can be heightened in positional accuracy, flow at the merging portion is smoothly formed, and a stable swirling flow being high in uniformity in a circumferential direction can be generated. Other objects, features, and advantages of the invention will become apparent from the following description of an embodiment of the invention when taken in conjunction with the accompanying drawings.

DESCRIPTION OF THE EMBODIMENTS

An embodiment of the invention will be described hereinafter with reference to FIGS. 1 to 7.

Figure 1:
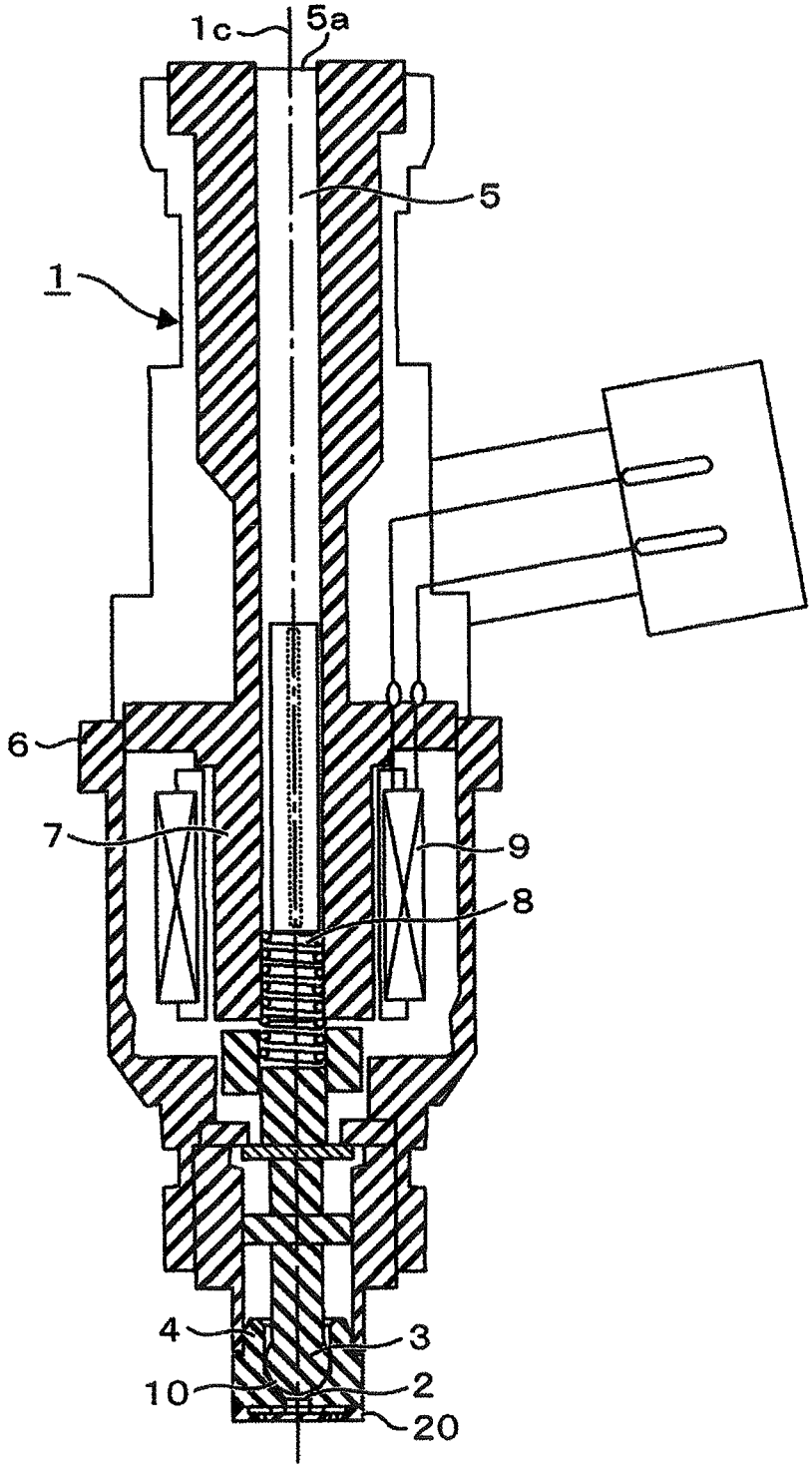
FIG. 1 is a longitudinal section showing the whole configuration of a fuel injection valve, according to the invention, in cross section along a valve axis.
Figure 2:
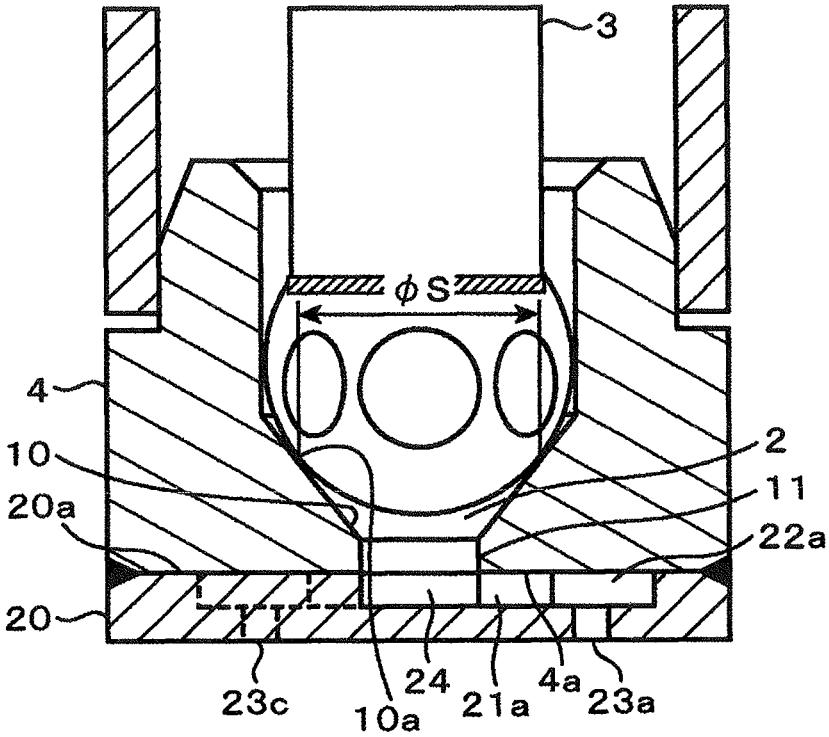
FIG. 2 is a longitudinal section showing the neighborhood of a nozzle body in the fuel injection valve according to the invention.
Figure 3:
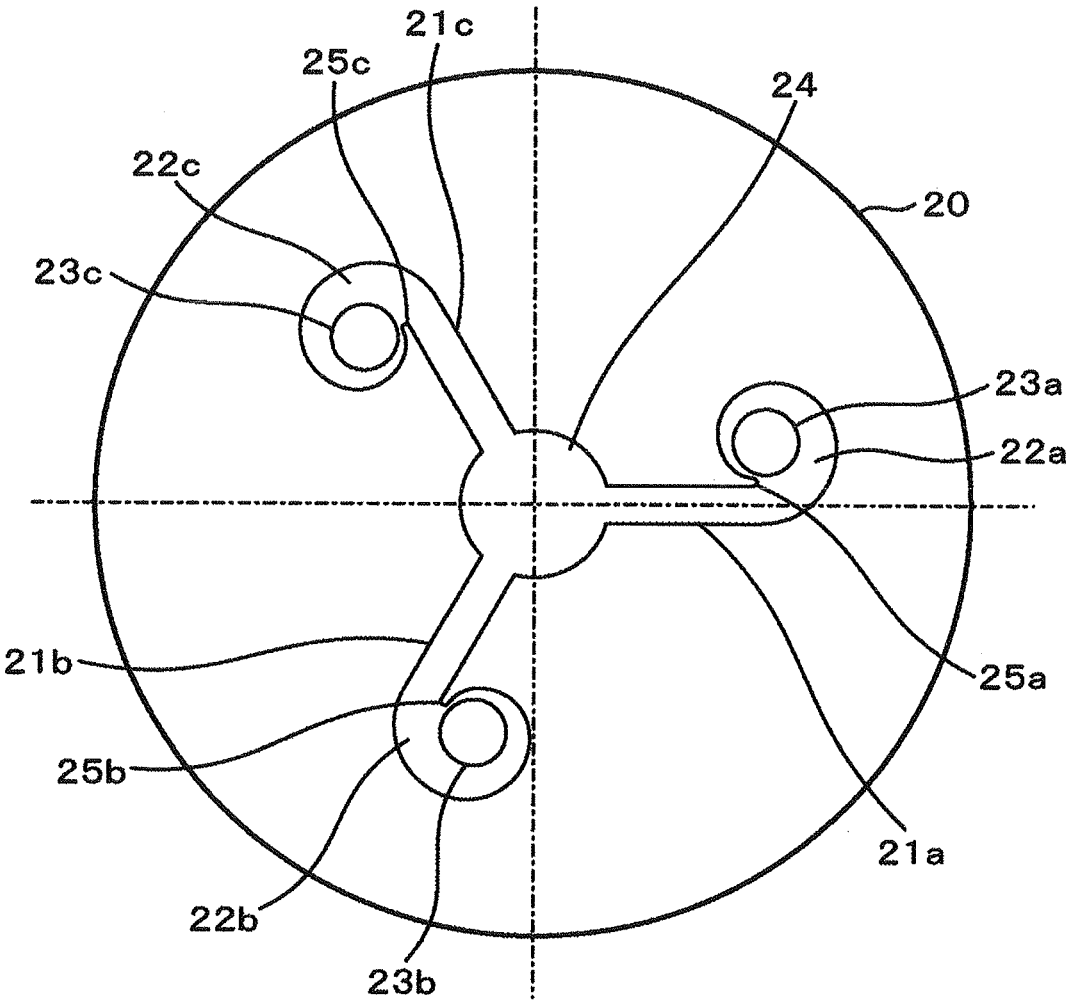
FIG. 3 is a plan view of an orifice plate positioned at a lower end of the nozzle body in the fuel injection valve according to the invention.

Referring to FIGS. 1 to 3, a fuel injection valve 1 comprises a magnetic yoke 6 surrounding an electromagnetic coil 9, a core 7 positioned centrally of the electromagnetic coil 9 and in contact at one end thereof with the yoke 6, a valve body 3, which lifts a predetermined amount, a valve seat surface 10 brought into contact with the valve body 3, a fuel injection chamber 2, which permits passage of a fuel flowing through a clearance between the valve body 3 and the valve seat surface 10, and an orifice plate 20 having a plurality of fuel injection ports 23*a*, 23*b*, 23*c* disposed downstream of the fuel injection chamber 2.

Provided centrally of the core 7 is a spring 8, which pushes the valve body 3 against the valve seat surface 10.

In a state, in which the coil 9 is not energized, the valve body 3 and the valve seat surface 10 come into closely contact with each other. In this state, since a fuel passage is closed, a fuel remains in the fuel injection valve 1 and fuel injection is not performed from each of the fuel injection ports 23*a*, 23*b*, 23*c* provided in plural.

When the coil 9 is energized, the valve body 3 is moved by an electromagnetic force until it abuts against a lower end surface of the core 7 opposed to the valve body 3.

In this valve opened state, since a clearance is formed between the valve body 3 and the valve seat surface 10, the fuel passage is opened to permit a fuel to be injected from the plurality of fuel injection ports 23*a*, 23*b*, 23*c*.

The fuel injection valve 1A is formed with a fuel passage 5 having a fuel inlet 5*a*, and the fuel passage 5 is one, which includes a through-hole portion extending through the center of the core 7 and through which a fuel pressurized by a fuel pump (not shown) is led to the fuel injection ports 23*a*, 23*b*, 23*c* through an interior of the fuel injection valve 1.

As described above, as the coil 9 is energized (injection pulse), the fuel injection valve 1 switches the position of the valve body 3 between a valve opened state and a valve closed state to control a fuel feed rate. The valve body is designed to eliminate fuel leakage in the valve closed state.

In fuel injection valves of this kind, balls (steel balls for ball bearings on JIS Standards), which are high in roundness and subjected to mirror finish, are used for the valve body 3 to be beneficial to an improvement in seating quality.

On the other hand, the valve seat angle of the valve seat surface 10, with which the ball comes into close contact, is from 80° to 100°, which is optimum to provide for a favorable abrasive quality and to enable maintaining the ball seat quality very high.

In addition, a nozzle body 4 having the valve seat surface 10 is heightened in hardness by means of hardening and also relieved of useless magnetism by means of demagnetizing treatment.

Such structure of the valve body 3 enables injection quantity control without fuel leakage. Therefore, the valve body structure is made excellent in cost performance.

As shown in FIG. 2, the orifice plate 20 has its upper surface 20*a* in contact with a lower surface 4*a* of the nozzle body 4 and an outer periphery of the contact portion is subjected to laser welding to be fixed to the nozzle body 4.

In addition, a vertical direction described in the specification and claims of the present application is based on FIG. 1 such that the fuel inlet 5*a* is on an upper side and the fuel injection ports 23*a*, 23*b*, 23*c* are on a lower side in a direction along a valve axis 1*c* of the fuel injection valve 1.

Provided at a lower end of the nozzle body 4 is a fuel introducing port 11 having a smaller diameter than the diameter $\phi S$ of a seat portion 10*a* of the valve seat surface 10. The valve seat surface 10 is conical-shaped to be formed centrally of a downstream end thereof with the fuel introducing port 11. The valve seat surface 10 and the fuel introducing port 11 are formed so that a center line of the valve seat surface 10 and a center line of the fuel introducing port 11 agree with the valve axis 1*c*. The fuel introducing port 11 forms that opening on the lower end surface 4*a* of the nozzle body 4, which is communicated to a central hole (central port) 24 of the orifice plate 20.

The central hole 24 is a concave-shaped portion provided on the upper surface 20*a* of the orifice plate 20, swirl passages 21*a*, 21*b*, 21*c* extend radially from the central hole 24, and upstream ends of the swirl passages 21*a*, 21*b*, 21*c* are opened to an inner peripheral surface of the central hole 24 to be communicated to the central hole 24.

A downstream end of the swirl passage 21*a* is connected to a swirl chamber 22*a*, a downstream end of the swirl passage 21*b* is connected to a swirl chamber 22*b*, and a downstream end of the swirl passage 21*c* is connected to a swirl chamber 22*c*. The swirl passages 21*a*, 21*b*, 21*c* serve as fuel passages, through which a fuel is supplied to the swirl chambers 22*a*,

22*b*, 22*c*, respectively, and in this sense, the swirl passages 21*a*, 21*b*, 21*c* may be called swirling fuel supply passages.

Wall surfaces of the swirl chambers 22*a*, 22*b*, 22*c* are formed to be gradually increased in curvature toward a downstream side from an upstream side (gradually decreased in radius of curvature). In this respect, the curvature may be continuously increased, or stepwise gradually increased toward a downstream side from an upstream side while the curvature is made constant in a predetermined range. A typical example of a curve continuously increased in curvature toward a downstream side from an upstream side includes an involute curve (configuration), or a spiral curve (configuration). While the embodiment has been described with respect to a spiral curve, the explanation is applicable even when an involute curve is adopted assuming that the curvature is gradually increased toward a downstream side from an upstream side.

The fuel injection ports 23*a*, 23*b*, 23*c*, respectively, are opened centrally of the swirl chambers 22*a*, 22*b*, 22*c*.

Both the nozzle body 4 and the orifice plate 20 are formed so that positioning thereof is simply and readily carried out, and heightened in dimensional accuracy at the time of assembling.

The orifice plate 20 is manufactured by means of press-forming (plastic working), which is advantageous in mass-productiveness. In addition, other methods, such as electrical discharge machining, electroforming, etching working, etc., in which stress is not applied comparatively and which are high in machining accuracy, than the above method are conceivable.

Subsequently, the structure of the orifice plate 20 will be described in detail with reference to FIGS. 3 to 7.

Referring to FIG. 3, the orifice plate 20 is formed with the central hole 24 communicated to the fuel introducing port 11, and the central hole 24 is connected to the three swirl passages 21*a*, 21*b*, 21*c* arranged at regular intervals (intervals of 120 degrees) in a circumferential direction of the central hole and extended radially toward an outer peripheral side in a diametrical direction.

Figure 4:
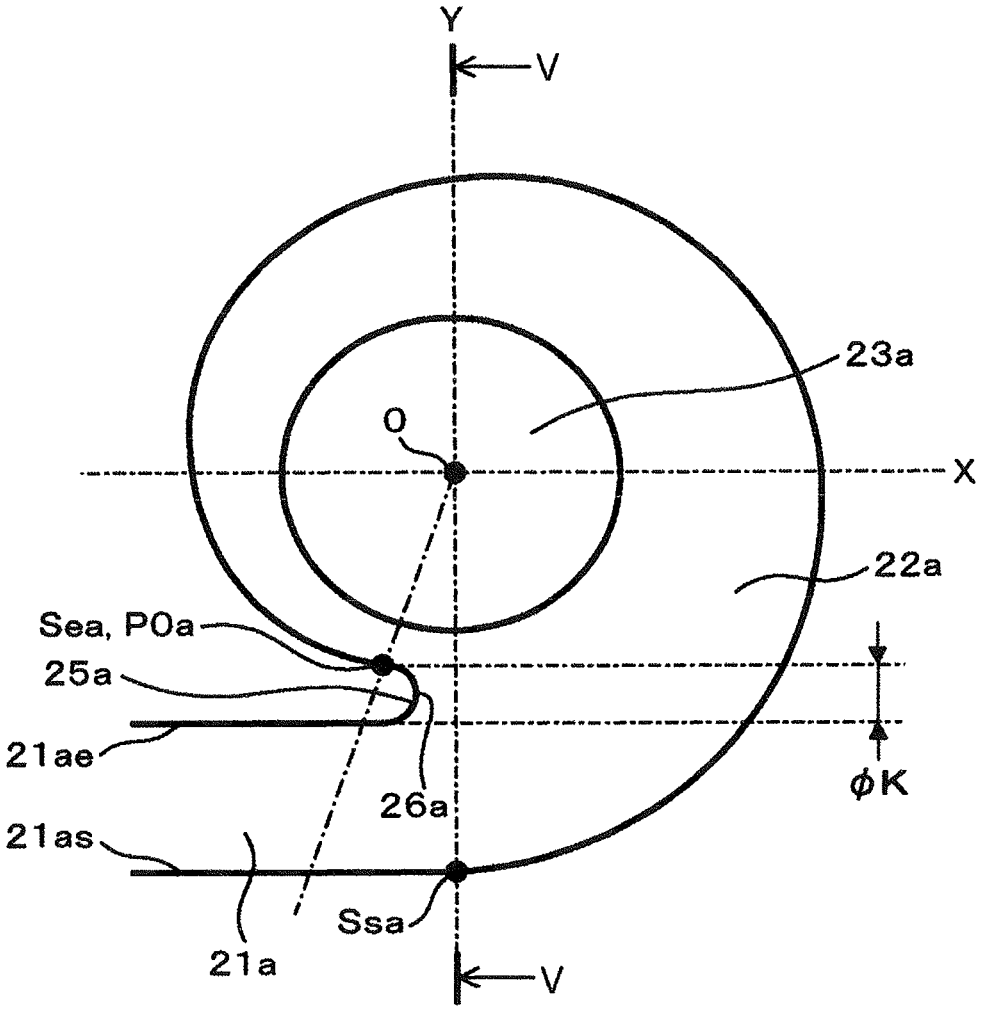
FIG. 4 is a plan view illustrating the relationship among a swirl chamber, a swirl passage, and a fuel injection port in the fuel injection valve according to the invention.
Figure 5:
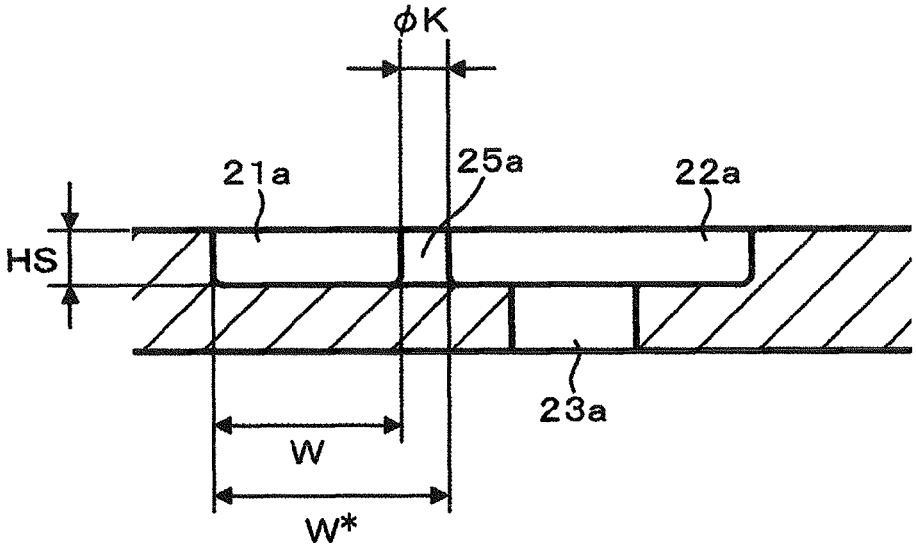
FIG. 5 is a cross sectional view taken along the line V-V in FIG. 4 and illustrating the relationship among the swirl chamber, the swirl passage and the fuel injection port.

Referring to FIGS. 4 and 5, one 21*a* of the swirl passages is opened tangentially of the swirl chamber 22*a* and the fuel injection port 23*a* is opened centrally of the swirl chamber 22*a*. In addition, according to the embodiment, an inner peripheral wall of the swirl chamber 22*a* is formed to draw a spiral curve on a plane (section) perpendicular to the valve axis 1*c*, that is, spiral-shaped so that a vortical center of the spiral curve and a center of the fuel injection port 23*a* agree with each other. In the case where the swirl chamber 22*a* is defined by an involute curve, it is formed so that a center of a basic circle of the involute curve and the center of the fuel injection port 23*a* agree with each other. However, the center of the fuel injection port 23*a* may be arranged offset from the vortical center of the spiral curve and the center of the basic circle of the involute curve.

The spiral shape of the swirl chamber is formed so that a radius R of the spiral curve meets the relationships represented by the formulae (1) and (2).

$$R=D/2\times(1-a\times\theta) \quad (1)$$

$$a=W^*/(D/2)/(2\pi) \quad (2)$$

Here, D indicates a diameter of a basic circle, W* indicates a width of a swirl passage, and W* in the invention is a numeric value including a thickness ϕK (shown in FIGS. 4 and 5).

An inner peripheral surface of the swirl chamber 22*a* includes a starting end (upstream end) Ssa and a terminating end (downstream end) Sea. One 21*as* of side walls of the swirl passage 21*a* is connected tangentially to the starting end (starting point) Ssa. Provided at the terminating end (terminating point) Sea is a circular-shaped portion 26*a* formed to come into contact with the spiral curve at the terminating point Sea. Since the circular-shaped portion 26*a* is formed over the whole of the swirl passage 21*a* and the swirl chamber 22*a* in a heightwise direction (direction along a swirl central axis), it defines a partial cylindrical-shaped portion formed in a predetermined angular range in a circumferential direction. The other 21*ae* of the side walls of the swirl passage 21*a* is formed to come into contact with a cylindrical-shaped surface defined by the circular-shaped portion 26*a*.

The cylindrical-shaped surface defined by the circular-shaped portion 26*a* defines a connecting surface (intermediate surface) connecting between a downstream end of the side wall 21*ae* of the swirl passage 21*a* and the terminating end Sea of the inner peripheral surface of the swirl chamber 22*a*. Also, owing to the provision of the connecting surface 26*a*, it is possible to provide a thickness forming portion 25*a* on a connection of the swirl chamber 22*a* and the swirl passage 21*a*, thus enabling connecting the swirl chamber 22*a* and the swirl passage 21*a* with a wall surface, which has a predetermined thickness, therebetween. In other words, a configuration, which is sharp at the point like a knife edge, is not formed on the connection of the swirl chamber 22*a* and the swirl passage 21*a*.

A connection of the side wall 21*ae* of the swirl passage 21*a* and the swirl chamber 22*a* will be described later in detail.

The fuel injection ports 23*a*, 23*b*, 23*c* are opened in a direction (a fuel outflow direction, a direction along a central axis), which is parallel to the valve axis 1*c* of the fuel injection valve 1 and downward in the embodiment, but may be inclined at a desired direction relative to the valve axis 1*c* to diffuse sprays (make respective sprays distant from one another to restrict interference).

As shown in FIG. 5, that cross sectional shape of the swirl passage 21*a*, which is perpendicular to a flow direction, is a rectangle (rectangular shape) and designed to measure a dimension, which is advantageous to press-forming. In particular, workability is made advantageous by making a height HS of the swirl passage 21*a* small as compared with a width W.

Since the rectangular portion constitutes a throttle (minimum cross sectional area), design is accomplished so as to enable neglecting that pressure loss, which is caused until a fuel flowing into the swirl passage 21*a* reaches the swirl passage 21*a* through the fuel injection chamber 2, the fuel introducing port 11, and the central hole 24 of the orifice plate 20 from the seat portion 10*a* of the valve seat surface 10.

In particular, the fuel introducing port 11 and the central hole 24 of the orifice plate 20 are designed to define a fuel passage of a desired dimension so as not to cause a pressure loss due to a sharp bend.

Accordingly, pressure energy of a fuel is efficiently converted at the swirl passage 21*a* into swirl speed energy.

Flow accelerated at the rectangular portion is led to the fuel injection port 23*a* on the downstream side while maintaining adequate swirl intensity, that is, so-called swirl speed energy.

Swirl intensity (swirl number S) of a fuel is represented by the formula (3).

$$S=d\cdot LS/n\cdot ds^2 \quad (3)$$

$$ds=2\cdot W\cdot HS/(W+HS) \quad (4)$$

Here, d indicates a diameter of a fuel injection port, LS indicates a distance between the center line of the swirl passage W and a center of the swirl chamber DS, and n indicates the number of swirl passages, one in the embodiment.

Also, ds indicates a hydraulic diameter converted from a swirl passage and is represented by the formula (4), W indicates a width of a swirl passage, and HS indicates a height of a swirl passage.

The diameter DS of the swirl chamber 22*a* is determined so that influences of friction loss caused by a fuel flow and of friction loss on a chamber wall are made as small as possible.

The dimension about four to six times a hydraulic diameter ds is made an optimum value, and this method is applied in the embodiment.

As described above, in the embodiment, the thickness forming portion 25*a* is formed on the connection of a downstream end of the inner peripheral wall of the swirl chamber 22*a* and the swirl passage 21*a* to have a predetermined thickness ϕK.

Since the relationship among the swirl passage 21*b*, the swirl chamber 22*b* and the fuel injection port 23*b* and the relationship among the swirl passage 21*c*, the swirl chamber 22*c* and the fuel injection port 23*c* are the same as the relationship among the swirl passage 21*a*, the swirl chamber 22*a* and the fuel injection port 23*a*, an explanation therefore is omitted.

In addition, while fuel passages comprising a combination of the swirl passage 21, the swirl chamber 22 and the fuel injection port 23 are provided in three sets according to the embodiment, they may be further increased to heighten the configuration of spray and variations of injection quantity in degree of freedom. Also, fuel passages comprising a combination of the swirl passage 21, the swirl chamber 22 and the fuel injection port 23 may be provided in two sets, or one set.

Since a fuel passage comprising a combination of the swirl passage 21*a*, the swirl chamber 22*a* and the fuel injection port 23*a*, a fuel passage comprising a combination of the swirl passage 21*b*, the swirl chamber 22*b* and the fuel injection port 23*b*, and a fuel passage comprising a combination of the swirl passage 21*c*, the swirl chamber 22*c* and the fuel injection port 23*c* are structured in the same manner, the respective fuel passages are not distinguished in the following descriptions but described simply as the swirl passage 21, the swirl chamber 22 and the fuel injection port 23.

Figure 6:
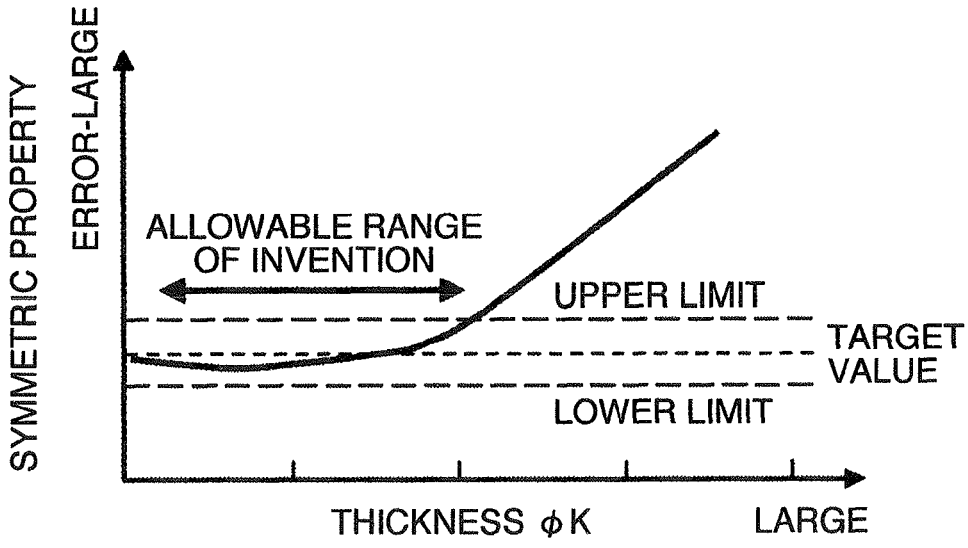
FIG. 6 is a view illustrating the relationship between the thickness of a thickness forming portion and an error in symmetric property of spray.
Figure 7:
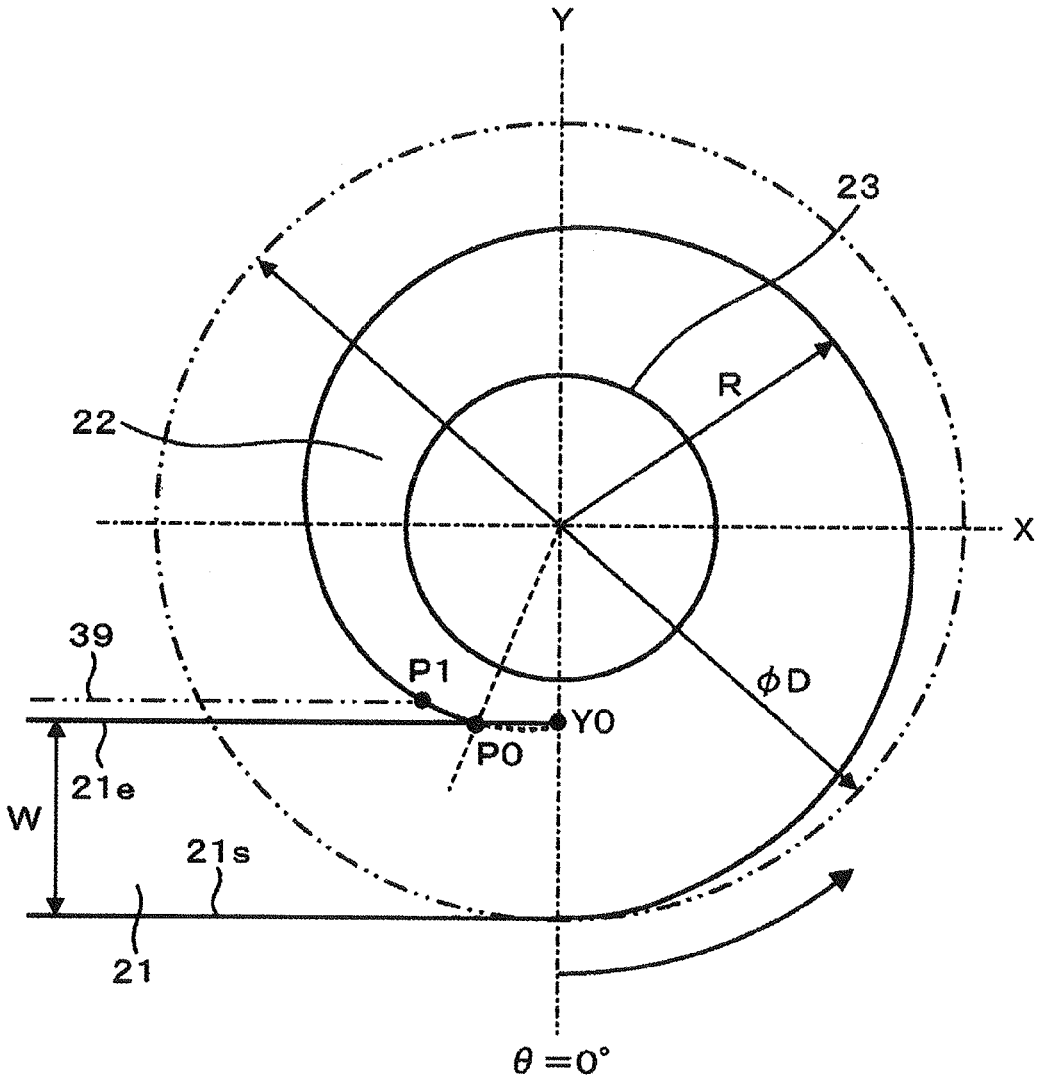
FIG. 7 is a plan view showing an example, in which a connection of the swirl chamber and the swirl passage is edged to be sharp at the point like a knife edge.
Figure 8A:
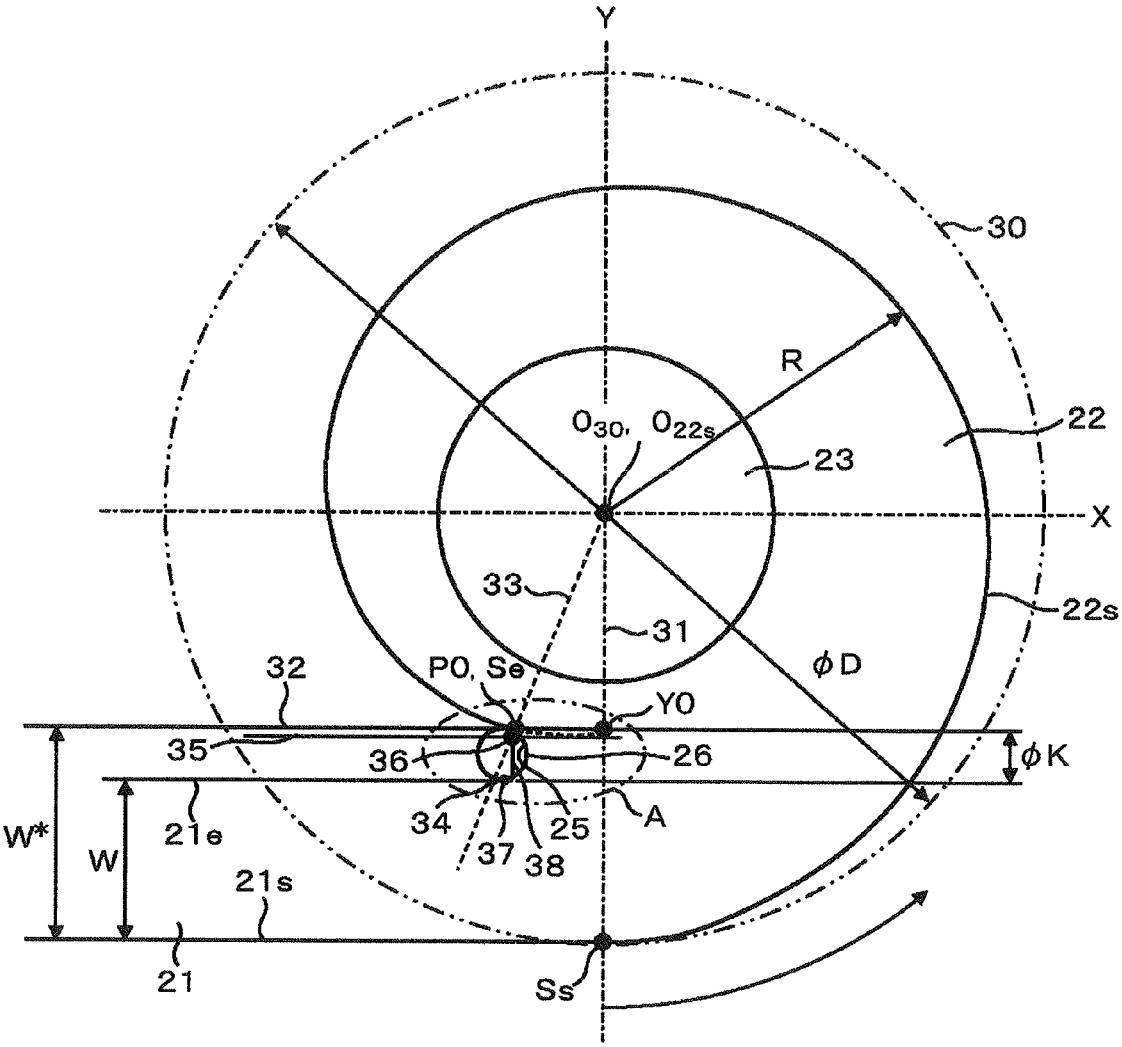
FIG. 8A is a plan view illustrating, in detail, the structure of the thickness forming portion in the fuel injection valve according to the invention.

The action and function of the thickness forming portion 25*a* will be described with reference to FIGS. 6 to 9. FIG. 6 is a view illustrating the relationship between the thickness of the thickness forming portion 25*a* and an error in symmetric property of spray. FIG. 7 is a plan view showing an example, in which a connection PO of the swirl chamber 22*a* and the swirl passage 21*a* is edged (thickness of less than 0.01 mm) to be sharp at the point like a knife edge. FIG. 8A is a plan view illustrating the structure of the thickness forming portion 25 in detail. FIG. 9 is a plan view illustrating a difference of flow between the structure in FIG. 7 and the structure in FIG. 8A.

FIG. 7 shows an example, in which the side wall 21*e* of the swirl passage 21 and the inner peripheral wall of the swirl chamber 22 intersect each other. The side wall 21*e* and the inner peripheral wall of the swirl chamber 22 intersect each other whereby an edge-shaped portion being sharp at the point like a knife edge is formed on the connection PO. The current processing technique makes it possible to make the thickness of the edge-shaped portion less than 0.01 mm.

The connection PO is a point of intersection, at which a spiral curve drawn by the inner peripheral wall of the swirl chamber 22 intersects a line extended perpendicular from a position YO at which the spiral curve drawn by the inner peripheral wall of the swirl chamber 22 intersects the Y axis, and a portion of the extended line on the left of PO defines the side wall 21*e* of the swirl passage 21.

A point P1 indicates a position of a connection in the case where the swirl passage 21 is manufactured to be large in width and in the case where a side wall is provided in a position 39. In such case, a collision angle of a fuel orbiting in the swirl chamber 22 and a fuel from the swirl passage 21 increases, so that an asymmetric swirling flow is fed to the fuel injection port 23.

Also, since the fuel injection port 23 is seen well from the swirl passage 21, a fuel inflowing from the swirl passage 21 becomes easy to flow steeply toward the fuel injection port 23 and so an asymmetric swirling flow is fed.

Since the thickness forming portion 25 having a predetermined thickness ϕK is provided on the connection, shown in FIG. 4, of the swirl chamber 22*a* and the swirl passage 21*a*, the symmetric property of spray can be made to assume a design target value as shown in FIG. 6.

The thickness forming portion 25 defines a wall surface having an origin corresponding to the point PO shown in FIG. 8A and is formed as a wall surface 26 drawing that circle of an optional diameter, which circumscribes the spiral curve of the swirl chamber 22 at the point PO.

Figure 8B:
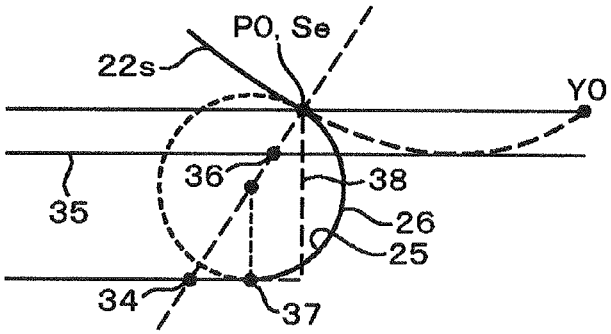
FIG. 8B is a view showing, in enlarged scale, an A-part in FIG. 8A.
Figure 9:
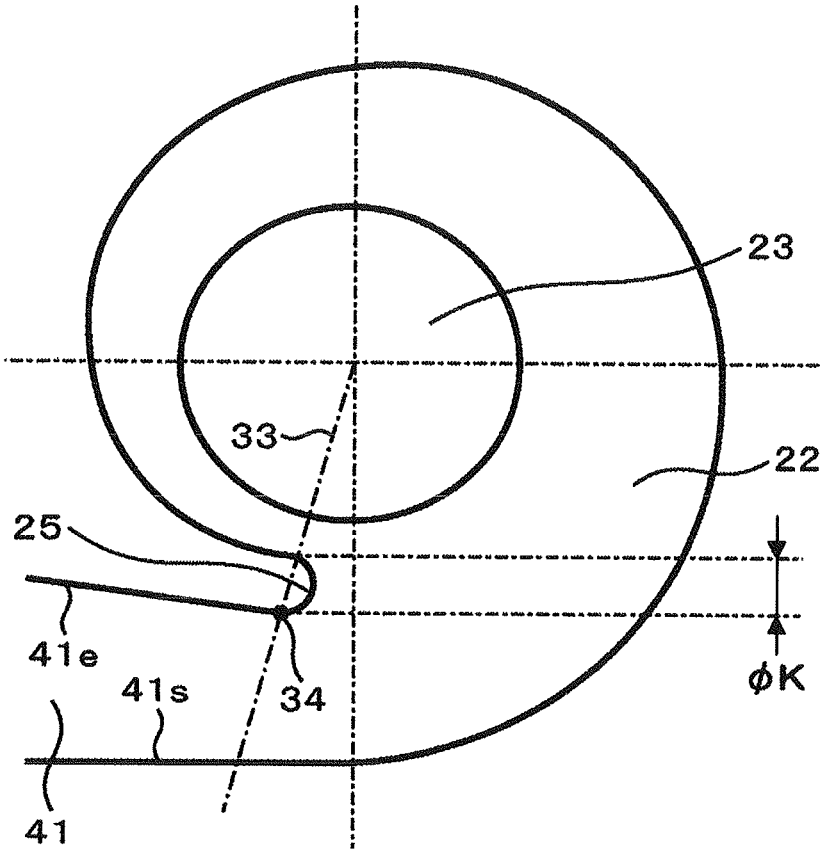
FIG. 9 is a plan view illustrating the relationship among the swirl chamber, the swirl passage and the fuel injection port when the swirl passage is tapered.

Referring to FIG. 8, the structure of the thickness forming portion 25 will be described in detail.

An extension of the side wall 21*e* (the wall surface in a heightwise direction) of the swirl passage 21 does not intersect an extension of a spiral curve 22*s*, which is drawn by the inner peripheral wall of the swirl chamber 22, in an angular range of more than 180 degrees rotated (orbited) from the starting point Ss of the spiral curve 22*s*. Thereby, a substantial thickness can be formed between the side wall 21*e* and the spiral curve 22*s* drawn by the inner peripheral wall of the swirl chamber 22.

A side wall 21*s* of the swirl passage 21 is formed in a manner to come into contact with a basic circle 30 at the point Ss. The basic circle 30 has its center $O_{30}$ agreeing with a center $O_{22S}$ of a spiral and has its radius R equal to a distance between the starting point Ss of the spiral curve 22*s* and the center $O_{22S}$ of the spiral. The center $O_{30}$ of the basic circle 30 and the center $O_{22S}$ of the spiral define a center of the swirl chamber. Also, the point Ss makes a starting point of the spiral curve 22*s* of the inner peripheral wall of the swirl chamber 22. Accordingly, the side wall 21*s* constitutes a side wall connected to an upstream side end of the spiral curve 22*s* drawn by the inner peripheral wall of the swirl chamber 22.

A first line segment (straight line) 31 connecting between the center $O_{30}$ (the center $O_{22S}$ of the spiral) of the basic circle 30 and the starting point Ss in an angular position rotated (orbited) 360 degrees from the starting point Ss is assumed. A first point Y0, at which the first line segment 31 and an extension of the spiral curve 22*s* intersect each other, is assumed. A second line segment (straight line) 32 passing through the first point Y0 and being perpendicular to the first line segment 31 is assumed. A second point P0, at which the second line segment 32 intersects the spiral curve 22*s* (or an extension thereof) on an upstream side of the first point Y0, is assumed. A third line segment (straight line) 33 connecting between the second point P0 and the center $O_{22S}$ of the spiral (the center $O_{30}$ of the basic circle 30) is assumed. A third point 34, at which the side wall 21*e* and the third line segment 33 intersect each other, is assumed. A fourth line segment (straight line) 35 being parallel to the second line segment 32 and in contact with an extension of the spiral curve 22*s* between the first point Y0 and the second point P0 is assumed. A fourth point 36, at which the fourth line segment 35 intersects the third line segment 33, is assumed.

In order to form a substantial thickness between the side wall 21*e* and the spiral curve 22*s* drawn by the inner peripheral wall of the swirl chamber 22, it suffices that the third point 34 be positioned on the third line segment 33 on a side more distant from the center $O_{22S}$ of the spiral (the center $O_{30}$ of the basic circle 30) than the fourth point 36. In this respect, an extension (or possibly, the side wall 21*e* itself) of the side wall 21*e* of the swirl passage 21 does not intersect the extension (or possibly, the spiral curve 22*s*, namely, the inner peripheral wall surface itself) of the spiral curve 22*s*, which is drawn by the inner peripheral wall of the swirl chamber 22, in an angular range of more than 180 degrees rotated (orbited) from the starting point Ss of the spiral curve 22*s*. That is, the extension of the side wall 21*e* of the swirl passage 21 connected to a downstream end side of the swirl chamber 22 does not intersect an extension of the swirl chamber 22 on the downstream end side.

In the embodiment, the side wall 21*e* is parallel to the side wall 21*s*. As shown in FIG. 9, also in the case where a side wall 41*e* is formed to make a space between it and a side wall 41*s* small as it goes toward a downstream side from an upstream side (taper off) and so a swirl chamber 41 is formed to taper off, a third point 34, at which the side wall 41*e* and a third line segment 33 intersect each other, may be arranged in the manner described above. In this case, however, since the side wall 41*e* is provided to be oblique to the side wall 21*e*, the extension of the side wall 21*e* can be made not to intersect the extension of the spiral curve 22*s* in an angular range of more than 180 degrees rotated (orbited) from the starting point Ss of the spiral curve 22*s* even when the third point 34 is positioned on the third line segment 33 on a side toward the center $O_{22S}$ of the spiral curve (the center $O_{30}$ of the basic circle 30) from the fourth point 36. In this case, it is important that the extension of the side wall 21*e* is made not to intersect the extension of the spiral curve 22*s* in an angular range of more than 180 degrees rotated (orbited) from the starting point Ss of the spiral curve 22*s*.

Also, the side wall 21*e* can be defined by a curve, in which case, likewise the swirl chamber 41 shown in FIG. 9, it is important that the extension of the side wall 21*e* is made not to intersect the extension of the spiral curve 22*s* in an angular range of more than 180 degrees rotated (orbited) from the starting point Ss of the spiral curve 22*s*.

The second point P0 defines a terminating end (terminating point) Se of the spiral curve 22*s* drawn by the inner peripheral wall of the swirl chamber 22. Provided at Se is a circular-shaped portion 26 formed so as to come into contact with the spiral curve 22*s* at the terminating point Se. Since the circular-shaped portion 26 is formed over the whole of the swirl passage 21 and the swirl chamber 22 in a heightwise direction (direction along a swirl central axis), it constitutes a partial cylindrical-shaped portion formed in a predetermined angular range in a circumferential direction. The side wall 21*e* of the swirl passage 21 is formed in a manner to come into contact with a cylindrical-shaped surface defined by the circular-shaped portion 26 and the contact point 37 defines a downstream end (terminating point) of the side wall 21*e* of the swirl passage 21. The cylindrical-shaped surface defined by the circular-shaped portion 26 constitutes a connecting surface (intermediate surface), which connects between the downstream end of the side wall 21*e* of the swirl passage 21 and the terminating end Se of the inner peripheral wall of the swirl chamber 22.

Also, the terminating end (terminating point) Se of the spiral curve 22*s* drawn by the inner peripheral wall of the swirl chamber 22 and the downstream end (terminating point) 37 of the side wall 21*e* of the swirl passage 21 are distant from each other to form a thickness ϕK. In this embodiment, the length of a perpendicular line from the terminating end (terminating point) Se of the spiral curve 22*s* to the extension of the side wall 21*e* is made the thickness ϕK. In addition, the terminating end (terminating point) Se of the spiral curve 22*s* drawn by the inner peripheral wall of the swirl chamber 22 and the downstream end (terminating point) 37 of the side wall 21*e* can be determined by a change in bend or curvature.

Also, the reason why "extension" is represented likewise "extension of the side wall 21*e*" and "extension of the spiral curve 22*s*" in the above description is that according to the embodiment, the terminating end Se of the spiral curve 22*s* is positioned upstream of a point Y0 on the spiral curve 22*s* and its extension. For example, in the case where the terminating end Se of the spiral curve 22*s* is made to agree with the point Y0, "the side wall 21*e*" and "the spiral curve 22*s*" should be described instead of "extension of the side wall 21*e*" and "extension of the spiral curve 22*s*".

While the above assumption and the structure have been described with respect to a spiral curve, they are also applicable to an involute curve when a spiral curve is replaced by the involute curve.

Also, the thickness forming portion 25 may be straight in cross section as shown by a line segment 38 in FIG. 8 instead of being partially circular. In this case, the thickness forming portion 25 is made a plane. It is preferable that the plane be formed as a surface in parallel to the Y-axis and perpendicular to the XY plane.

In addition, the thickness of the wall surfaces is formed to include an angle R and an angular chamfer (in the order of 0.005 mm), which are necessary in working.

FIG. 6 is a view illustrating the symmetric property of spray relative to the thickness ϕK of the thickness forming portion 25 and suggesting that a predetermined thickness range is effective in order to meet a target value.

The dimension of the thickness ϕK is allowed to range from about 0.01 mm to 0.1 mm and preferably adopts 0.02 mm to 0.06 mm with priority.

The thickness ϕK relaxes collision of a fuel orbiting in the swirl chamber 22 and a fuel inflowing from the swirl passage 21 to form a smooth flow along the spiral wall surface in the swirl chamber 22.

In addition, since the graph shown in FIG. 6 takes no consideration of dislocation of the connection of the swirl chamber 22 and the swirl passage 21, it results that a design target value is met even when the thickness ϕK of the thickness forming portion 25 is 0. It is seen from the graph of FIG. 6 that in order to meet the design target value, there exists an upper limit for the thickness ϕK. Also, while the graph of FIG. 6 shows the result of meeting the design target value even when the thickness ϕK is 0, this is because consideration is not taken of dislocation of the connection of the swirl chamber 22 and the swirl passage 21, and as described in "Background of the Invention", dislocation of the connection of the swirl chamber 22 and the swirl passage 21 is liable to generate in the case where the thickness ϕK is not provided (in case of 0). Accordingly, in view of dislocation of the connection in the case where the thickness ϕK is not provided, it is possible that the design target value is not met.

Figure 10A:
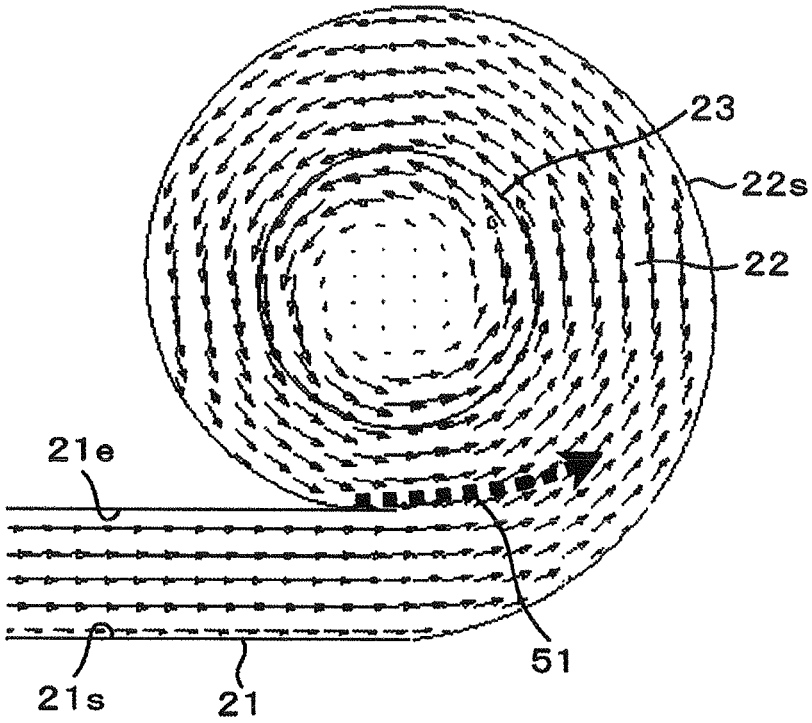
FIG. 10A is a view showing flow in the structure shown in FIG. 7.
Figure 10B:
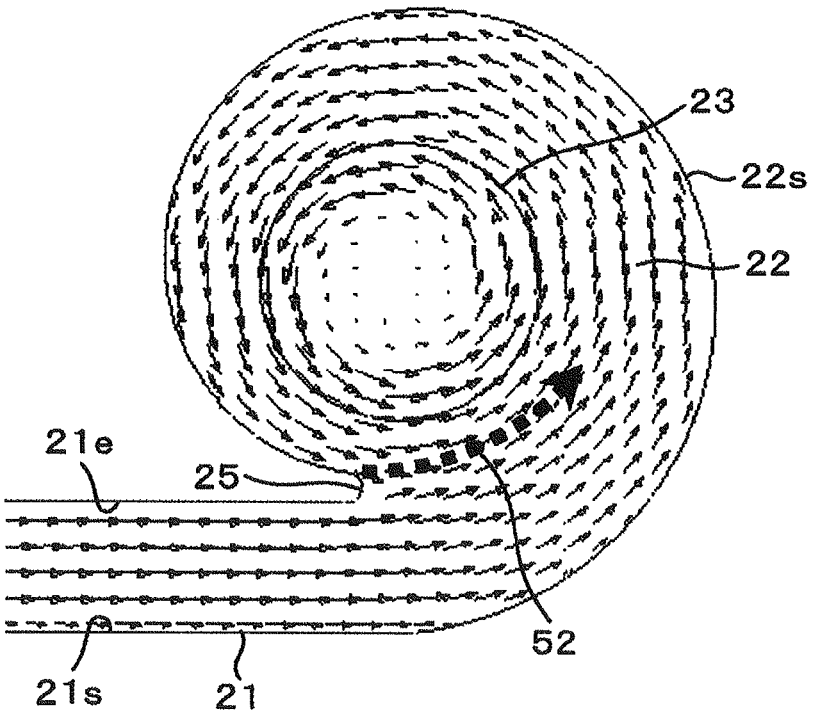
FIG. 10B is a view showing flow in the structure shown in FIG. 8A.

FIGS. 10A and 10B show results of analysis of fuel flow. Arrow vectors represent flows. FIG. 10A shows the case where the side wall 21*e* of the swirl passage 21 and the inner peripheral wall of the swirl chamber 22 intersect each other and an edge-shaped portion being sharp at the point like a knife edge is formed on the connection of the both walls. FIG. 10B shows the case where the thickness forming portion 25 is formed on the connection of the both walls.

Observing the flows shown in FIG. 10A, a fuel inflowing from the swirl passage 22 assumes a flow configuration, in which it merges into flows orbiting in the swirl chamber 21 and is pushed against a wall surface side of the swirl chamber 22 as shown by an arrow 51. In such case, a fuel spray (liquid film) flowing out of the fuel injection port 23 becomes asymmetric.

Observing the flows shown in FIG. 10B, collision of flows leaving the thickness ϕK of the connection and orbiting in the swirl chamber 22 and flows from the swirl passage 21 is relaxed and flows along the curvature of the swirl chamber 22 are formed as indicated by an arrow 52. In such case, flows are formed substantially symmetrically in the fuel injection port 23 and so fuel sprays injected from the fuel injection port 23 are made symmetrical.

The embodiment described above provides the following structure, action, and effect together.

The fuel injection port 23 is substantially large in diameter. When the diameter is made large, a cavity formed inside can be made substantially large. So-called swirl speed energy there can be made to act on thin film formation of an injected fuel without loss.

Also, since the ratio of an injection port diameter to a plate thickness (the same as the height of the swirl chamber in this case) of the fuel injection port 23 is made small, loss in swirl speed energy is very small. Therefore, a fuel atomizing property becomes very excellent.

Further, since the ratio of an injection port diameter to a plate thickness of the fuel injection port 23 is small, an improvement in press-forming is achieved.

With such structure, restriction of dimensional dispersion owing to an improvement in workability, not to mention the cost reduction effect, achieves a marked improvement in spray configuration and robustness of injection quantity.

As described above, with the fuel injection valve according to the embodiment of the invention, the predetermined thickness forming portion 25 is provided on the connection of the swirl chamber 22 and the swirl passage 21, 41 to ensure the symmetric property of an injected fuel to form a uniformly thin film, thereby accelerating atomization.

Since the thickness forming portion 25 aligns the swirling flow of a fuel, which orbits in the swirl chamber 22, in a direction of curvature of the spiral wall surface 22*s*, the fuel merges into a fuel, which inflows from the swirl passage 21, 41, to be accelerated to flow in the swirl chamber 22. At this time, a great collision of a fuel orbiting in the swirl chamber 22 and a fuel inflowing from the swirl passage 21 is avoided, so that the fuel orbiting in the swirl chamber 22 flows along the curved surface of the swirl chamber 22 while accelerating and inducing the fuel inflowing from the swirl passage 21.

Thereby, a symmetrical (uniform in a circumferential direction about a swirl central axis) liquid film made thin by an adequate swirl intensity is formed at the outlet of the fuel injection port 23 to enable accelerating atomization.

The fuel spray made uniformly thin in this manner actively makes an energy exchange with an ambient air to be accelerated in breakup to be made a spray of good atomization.

Also, design dimensions, which facilitate press-forming, can make a fuel injection valve excellent in cost performance and inexpensive.

While the embodiment has been described, it is apparent to those skilled in the art that the invention is not limited thereto but various changes and modifications may be made within the spirit of the invention and the scope as defined by the appended claims.

The invention claimed is:

1. A fuel injection valve including: a swirl chamber having an inner peripheral wall formed to be gradually increased in curvature toward a downstream side from an upstream side; a swirl passage, through which a fuel is introduced into the swirl chamber; and a fuel injection port opened to the swirl chamber, wherein the swirl chamber and the swirl passage are formed so that a side wall of the swirl passage connected to a downstream end side of the swirl chamber, or an extension thereof is made not to intersect a downstream side portion of the inner peripheral wall of the swirl chamber, or an extension thereof.

2. The fuel injection valve according to claim 1, wherein assuming, respectively, a first straight line segment connecting between a center of the swirl chamber and a starting point of the inner peripheral wall of the swirl chamber on an upstream side, a first point Y0, at which the first line segment and an extension of the inner peripheral wall extended toward a downstream side intersect each other, a second straight line segment passing through the first point Y0 and being perpendicular to the first line segment, a second point P0, at which the second line segment intersects the inner peripheral wall or an extension thereof on an upstream side of the first point Y0, a third straight line segment connecting between the second point P0 and the center of the swirl chamber, a third point, at which the side wall of the swirl passage and the third line segment intersect each other, a fourth straight line segment being parallel to the second line segment and in contact with the inner peripheral wall or an extension thereof between the first point and the second point, and a fourth point, at which the fourth line segment intersects the third line segment, the third point is positioned on the third line segment on a side more distant from the center of the swirl chamber than the fourth point.

3. The fuel injection valve according to claim 1, wherein the cross section of the swirl chamber is defined by an involute curve or a spiral curve.

4. The fuel injection valve according to claim 1, wherein a thickness forming portion is formed between a downstream end of the side wall of the swirl passage and a downstream end of the inner peripheral wall of the swirl chamber.

5. The fuel injection valve according to claim 4, wherein the cross section of the thickness forming portion is defined by a circular-shaped portion.

6. The fuel injection valve according to claim 5, wherein the circular-shaped portion is formed to be in contact with the inner peripheral wall and the side wall at the downstream end of the inner peripheral wall and the downstream end of the side wall.

7. A fuel injection valve including: a swirl chamber having an inner peripheral wall formed to be gradually increased in curvature toward a downstream side from an upstream side; a swirl passage, through which a fuel is introduced into the swirl chamber; and a fuel injection port opened to the swirl chamber, wherein a thickness forming portion is formed between a downstream end of a side wall of the swirl passage connected to a downstream end side of the swirl chamber and a downstream end of the inner peripheral wall of the swirl chamber.

8. The fuel injection valve according to claim 7, wherein that cross section of the thickness forming portion, which is perpendicular to a valve axis, is defined by a circular-shaped portion.

9. The fuel injection valve according to claim 8, wherein the circular-shaped portion is formed to be in contact with the inner peripheral wall and the side wall at the downstream end of the inner peripheral wall and the downstream end of the side wall.

* * * * *